US012677930B2

(12) United States Patent
Kim

(10) Patent No.: US 12,677,930 B2
(45) Date of Patent: Jul. 14, 2026

(54) BAG INCLUDING AN ADJUSTMENT SYSTEM

(71) Applicant: NIKE, Inc., Beaverton, OR (US)

(72) Inventor: George S. Kim, Wilsonville, OR (US)

(73) Assignee: NIKE, INC., Beaverton, OR (US)

( * ) Notice: Subject to any disclaimer, the term of this patent is extended or adjusted under 35 U.S.C. 154(b) by 77 days.

(21) Appl. No.: 18/819,317

(22) Filed: Aug. 29, 2024

(65) Prior Publication Data

US 2026/0060406 A1 Mar. 5, 2026

(51) Int. Cl.
*A45F 3/04* (2006.01)

(52) U.S. Cl.
CPC ..... *A45F 3/047* (2013.01)

(58) Field of Classification Search
CPC .... A45F 3/047; A45F 3/04; A45F 3/08; A45F 3/14; A45F 2003/122; A45C 13/30
USPC ..... 224/627, 196
See application file for complete search history.

(56) References Cited

U.S. PATENT DOCUMENTS 4,096,978 A * 6/1978 Noice ..... A45F 3/04 D3/217
9,320,341 B2 * 4/2016 Majeau ..... A45F 3/04
10,799,012 B2 * 10/2020 Uriarte ..... A45F 3/047
12,137,782 B2 * 11/2024 Sing ..... A45C 11/00

FOREIGN PATENT DOCUMENTS

WO WO-2022215368 A1 * 10/2022 ..... A45F 3/04

OTHER PUBLICATIONS

WO 2022215368 with Translation (Year: 2022).*

* cited by examiner

*Primary Examiner* — Adam J Waggenspack
(74) *Attorney, Agent, or Firm* — Bookoff McAndrews PLLC

(57) ABSTRACT

A bag with a compartment including one or more walls, a front panel, and a back panel opposite the front panel, each of the one or more walls, and the front and back panels surrounding an interior volume, wherein the front panel is movable between an open configuration, and a closed configuration, the front panel extending from a bottom end of the compartment to a top end of the compartment opposite the bottom end, and extending between a first side of the compartment and a second side of the compartment opposite the first side. An adjustment system with a base is disposed within the compartment. A first strap extending from a first end is attached at or near a roof of the compartment to a second end opposite the first end. A second strap is routed through the back panel, the second strap configured to act on the first strap.

19 Claims, 7 Drawing Sheets

BAG INCLUDING AN ADJUSTMENT SYSTEM

FIELD

The present invention relates in general to portable storage bags, and more particularly, to bags configured to maintain proper shoulder and upper body alignment of a user.

BACKGROUND

This section provides background information related to the present disclosure which is not necessarily prior art.

A bag may be worn by or secured to a user while the user is walking or standing. Some bags include straps with handles to facilitate tightening or loosening of the bag on the user's body. Adjusting the straps often leads to the bag being adjusted to a non-ideal location, and causing arching of the user's back to compensate for the weight of the bag.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

Corresponding reference numerals indicate corresponding parts throughout the several views of the drawings.

DETAILED DESCRIPTION

Figure 1:
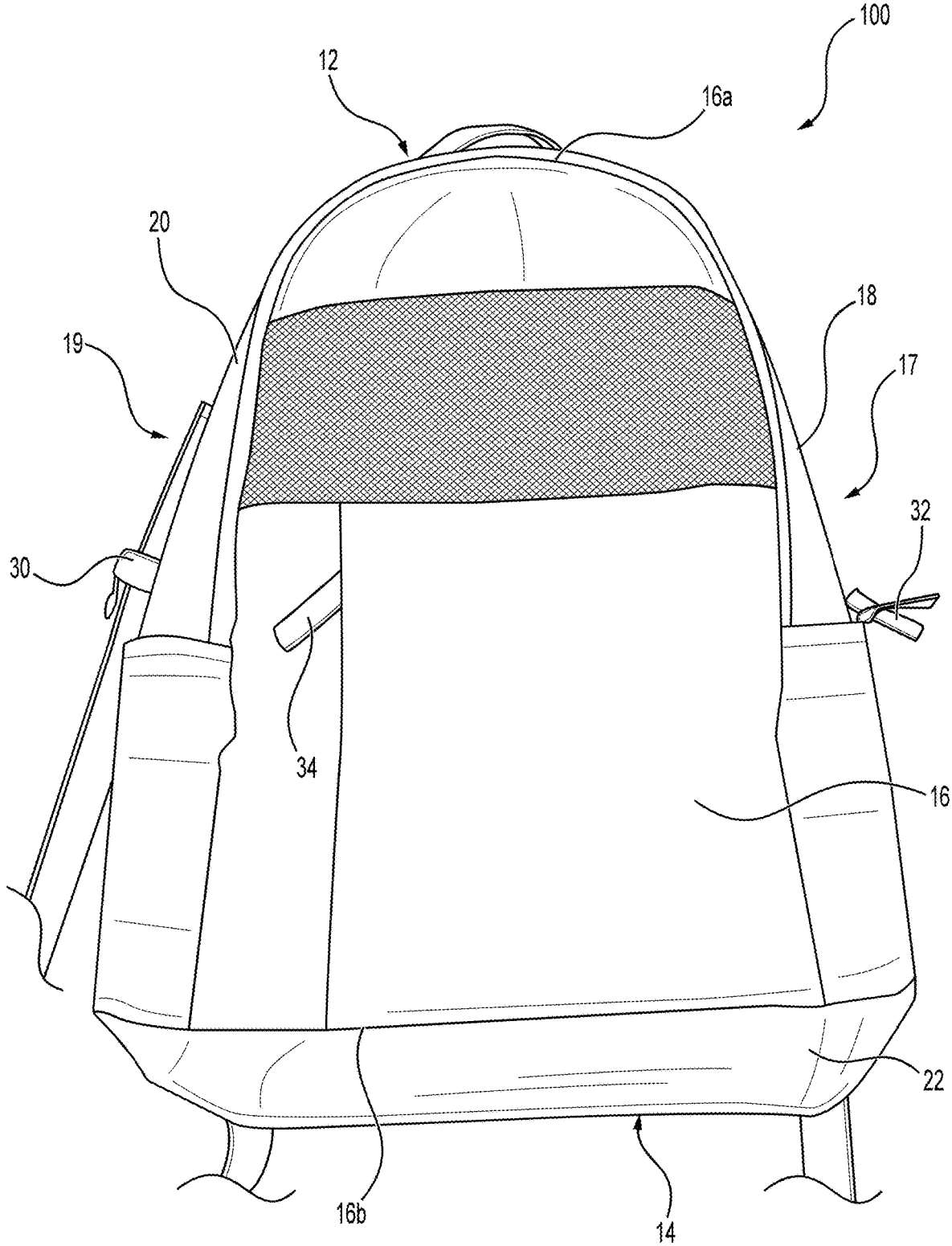
FIG. 1 is a front view of a storage bag.

The present disclosure overcomes these challenges and other known disadvantages with existing storage bags by providing a bag with a correction mechanism that allows for users to adjust their posture during use of the storage bag to reduce weight strain of the storage bag.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" may encompass both an orientation of above and below. When an element or layer includes the directional and/or spatial term (e.g., top, bottom, medial, lateral, etc.), the directional and/or spatial term is used relative to when the athletic equipment bag is upright on a flat, level surface. The device may be otherwise oriented (rotated 90 degrees or at other orientations) and the spatially relative descriptors used herein interpreted accordingly.

In the discussion that follows, terms "about," "approximately," "substantially," and the like, when used in describing a numerical value, denote a variation of +/−10% of that value, unless specified otherwise.

Although the description is in reference to a storage bag, it should be appreciated that such reference is merely exemplary. Bags include different types of portable storage apparatuses, such as, but not limited to, purses, backpacks, satchels, carriers, and the like. The technology disclosed herein may equally be used to create various types of bags. To alleviate confusion and to provide a more readable disclosure, embodiments simply reference bags. To that end and to provide a robust disclosure, different components or portions of bags are discussed herein, including zippers, panels, and compartments.

Aspects hereof provide a bag that includes a main storage compartment that is accessible by opening one or more panels. One or more of the panels are releasably fastened to adjacent panels by way of a closure system, such as a zipper or other releasable fastener (e.g., hook-and-loop strips, snaps, buttons, hooks, and the like). The bag might also include one or more accessory storage compartments constructed into the one or more panels or into a back panel of the bag.

The main storage compartment generally includes a storage space that may be larger than the accessory storage compartments and might include one or more additional storage pockets accessible from inside or outside the storage space. The accessory storage compartments are generally separated from the storage space of the main storage compartment and might be used to stow various items, such as athletic balls, footwear, towels, uniforms, sports drinks, sports supplements, and the like. The terms "storage" and "stowage" might be used interchangeably in this description, as well as the terms "storage area," "compartment," and "storage space." In addition, "accessory storage compartments" may also be referred to herein as "accessory compartments," "accessory pockets," "storage pockets," or just "pockets".

In a further aspect, the bag may be wearable as a backpack. For instance, the bag might include one or more straps that can be worn on one or both shoulders of a user. A normal manner of wear for the bag, when configured as a backpack, is for the user to place one or both arms through the one or more straps such that a panel of the backpack contacts the user's back. In one aspect, the backpack is configured such that items stored in the main storage compartment are accessible by opening the closure system (e.g., releasable fasteners) securing any one or more of the panels. Access may be allowed into the storage compartment from the top, bottom, left, or right side of the backpack, or any combination thereof, as opposed to limiting access from the top end of the backpack. Items stored within the accessory storage compartments are also accessible by opening any one or more of the fasteners or panels.

FIG. 1 illustrates an exemplary storage bag 100. The storage bag 100 includes a top end 12 and a bottom end 14 that is positioned opposite of the top end 12. The storage bag 100 includes a left side 17 and a right side 19. The storage bag 100 may include a first (front) panel 16, a first (left) wall 18, a second (right) wall 20, and a base 22. The first wall 18 is disposed on the left side 17. The second wall 20 is disposed on the right side 19. First panel 16 may be positioned between first wall 18 and second wall 20. Each of the first panel 16, the first wall 18, the second wall 20, and the base 22 may be coupled to a second (back) panel 24 (shown in FIG. 2). The first panel 16 has a longitudinal length that extends from a first end 16*a* (shown in FIG. 2) to a second end 16*b*. The first panel 16 generally opposes second panel 24, and the first panel 16 and second panel 24 at least partially enclose a main storage compartment 28 (shown in FIG. 3). The main storage compartment 28 having an interior volume to receive items therein. The interior volume is surrounded by the first panel 16, the second panel 24, the first wall 18, the second wall 20, and the base 22. The first panel 16 inhibits and enables access to the interior volume of the main storage compartment 28.

The first panel 16 is movable between a first (open) configuration and a second (closed) configuration, as will be described in greater detail herein. The first panel 16 reveals the main storage compartment 28 (shown in FIG. 3) when positioned in the open configuration. In an example, the second panel 24 faces a user's back and the first panel 16 faces away from a user's back when worn by the user in the normal manner.

In addition, the storage bag 100 has a closure system that includes one or more zippers 30 and 32 that provide access to the main storage compartment 28 (shown in FIG. 3) by way of the first panel 16. The closure system of the storage bag 100 may include one or more additional zippers 34 that provide access to additional portions of the storage bag 100. Each zipper 30 and 32 may extend along a zipper track. For exemplary purposes, a closure system including zipper attachments are described and depicted in the figures, however, it should be appreciated that any suitable releasable fastener might be used to connect various panels and/or portions of the storage bag 100, such as snaps, hook-and-loop fastening strips, clips, and the like.

Figure 2:
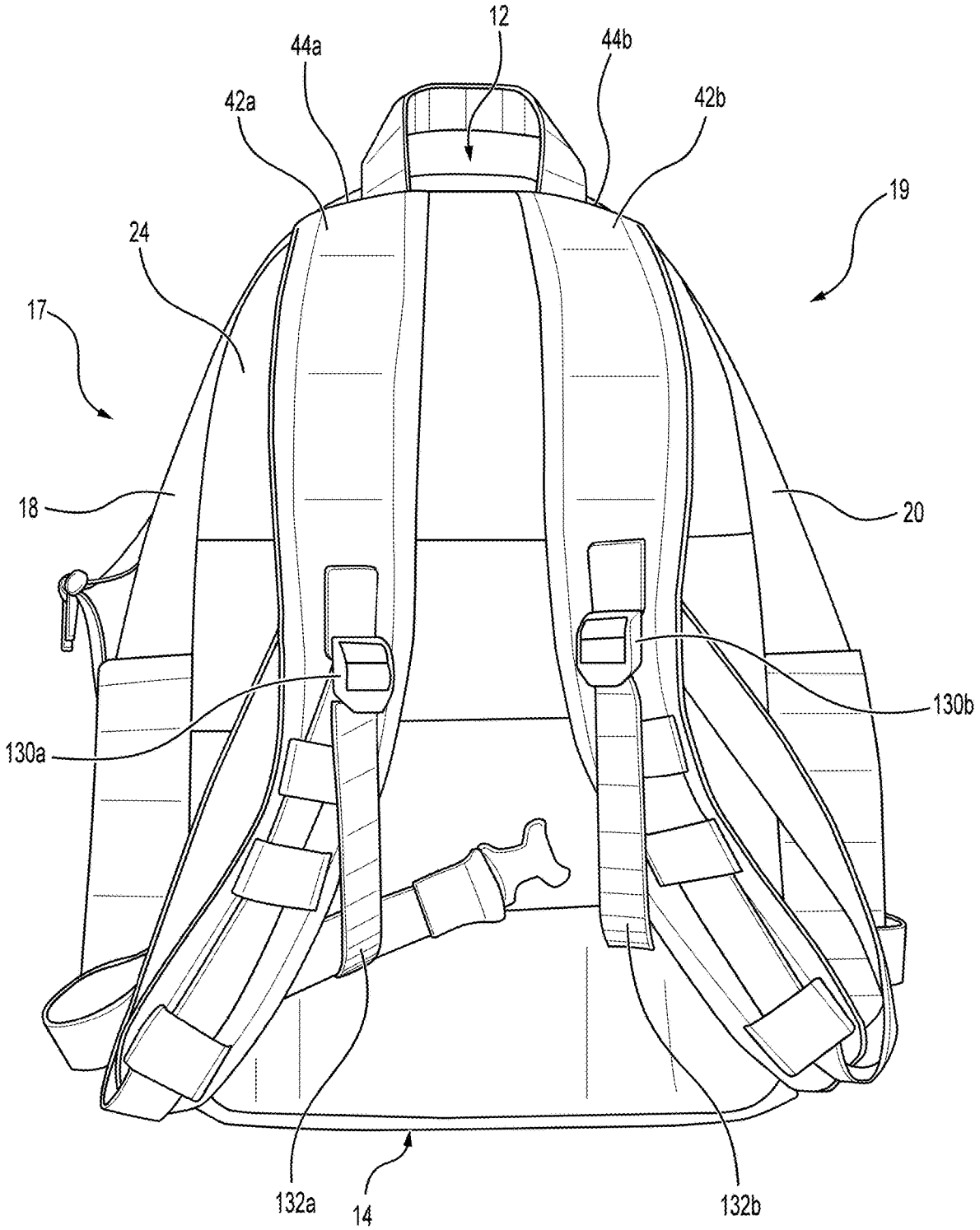
FIG. 2 is a rear view of the storage bag of FIG. 1.

Referring to FIG. 2, the storage bag 100 may include one or more bands 42*a*, 42*b* (e.g., first band 42*a* and second band 42*b*) that may be sized, shaped, and/or otherwise configured to facilitate securing the storage bag 100 to a user for ease in portability as well as adjusting the posture of the user. The bands 42*a*, 42*b* may include one or more features (e.g., cushions, mesh, etc.) that provide desired forms of comfortability or breathability. The bands 42*a*, 42*b* may be integrally formed or separately connectable to the storage bag 100, as will be described in further detail herein. The bands 42*a*, 42*b* extend away from the top end 12. In an example, a first end 44*a* of the first band 42*a* is connected at or near the top end 12. In an example, a first end 44*b* of the second band 42*b* is connected at or near the top end 12. The first ends 44*a*, 44*b* are attached or otherwise fixed ends of the respective bands 42*a*, 42*b*. In an example, the first band 42*a* extends from the first end 44*a* to a second end 46*a*. In an example, the second band 42*b* extends from the first end 44*b* to a second end 46*b*. The second ends 46*a*, 46*b* are unattached or otherwise free ends of the respective bands 42*a*, 42*b*. As an example, the storage bag 100 may include two straps, however, the storage bag 100 may include any number of bands 42*a*, 42*b*.

The first band 42*a* may be configured to be worn over a right shoulder of a user 200 (shown in FIG. 5) and extend down a right side of an upper body or torso of the user 200, and the second band 42*b* may be configured to be worn over a left shoulder of the user 200 and extend down a left side of the upper body of the user 200. A configuration of the first band 42*a* may mirror a configuration of the second band 42*b*. Each of the bands 42*a*, 42*b* include one or more rings (first ring 130*a* and second ring 130*b*). The one or more rings 130*a*, 130*b* may be a D-ring, a G-ring, an O-ring, a carabineer, or may have any other type of ring that has a suitable shape for connecting portions of the storage bag 100 or the bands 42*a*, 42*b*.

The first band 42*a* further includes a substrap 132*a*. The second band 42*b* further includes a substrap 132*b*. The substrap 132*a* is configured to transition the storage bag 100 between an engaged configuration and a relaxed configuration, as will be described in further detail below. A portion of the substrap 132*a* is routed through the first ring 130*a*. The substrap 132*b* is configured to transition the storage bag 100 between an engaged configuration and a relaxed configuration, as will be described in further detail below. A portion of the substrap 132*b* is routed through the second ring 130*b*. As will be described in further detail below, the substraps 132*a*, 132*b* are respective ends of a continuous strap.

In further examples, the bands 42*a*, 42*b* might be coupled to other portions of the storage bag 100 than the second panel 24 and/or at other ends than the top end 12 (e.g., bottom end 14). Also, the bands 42*a*, 42*b* might be fixedly attached to the sides or bottom of the storage bag 100 in a non-adjustable manner. Bands 42*a*, 42*b* may be comprised of multiple layers of fabrics or materials, which may include, but is not limited to, a mesh, a polyester, cotton, foam, silicon, air pockets, or any other fabric, padding material, or the like.

Figure 3:
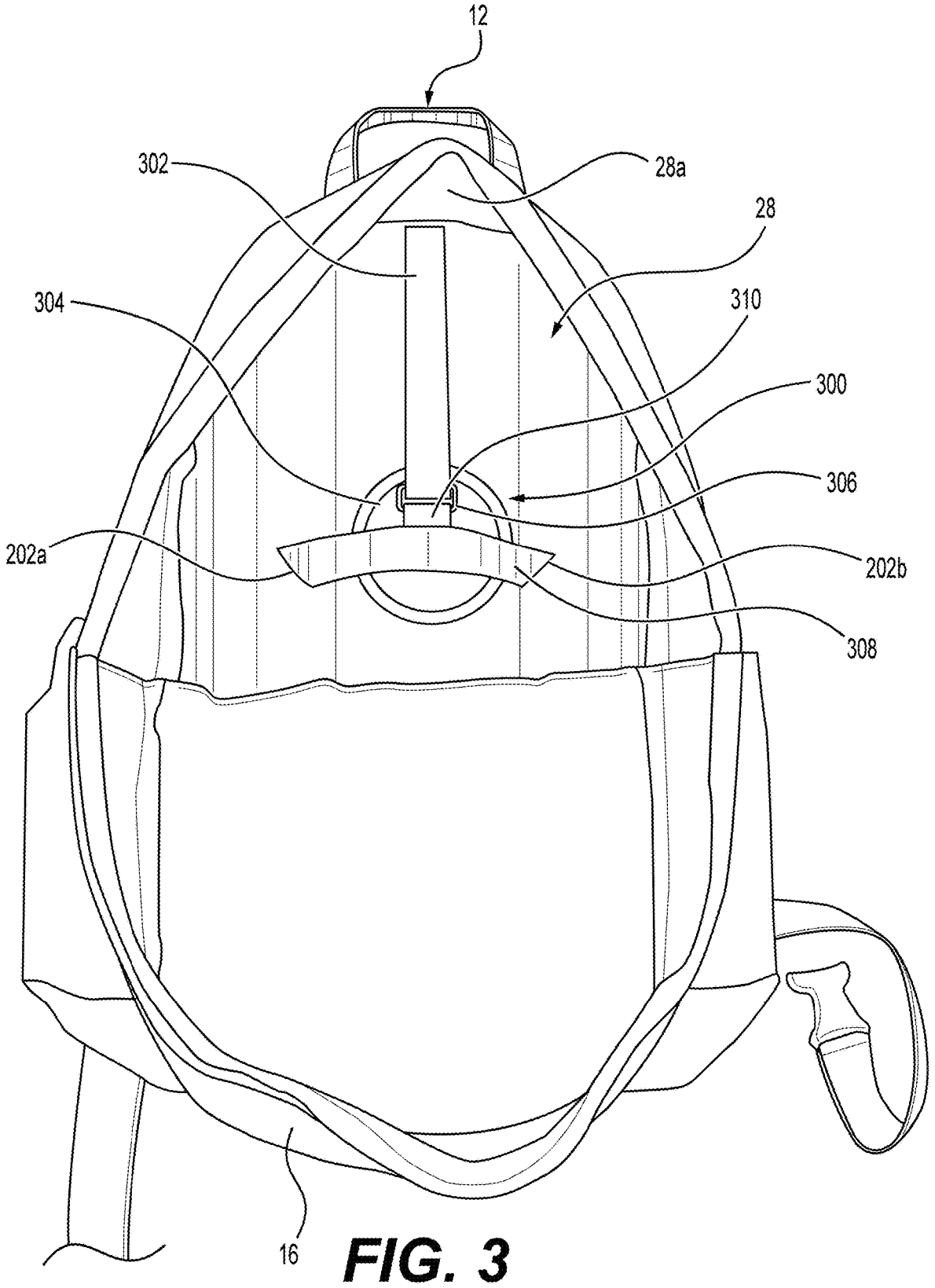
FIG. 3 is a front view of an interior pocket of the storage bag of FIG. 1.
Figure 4:
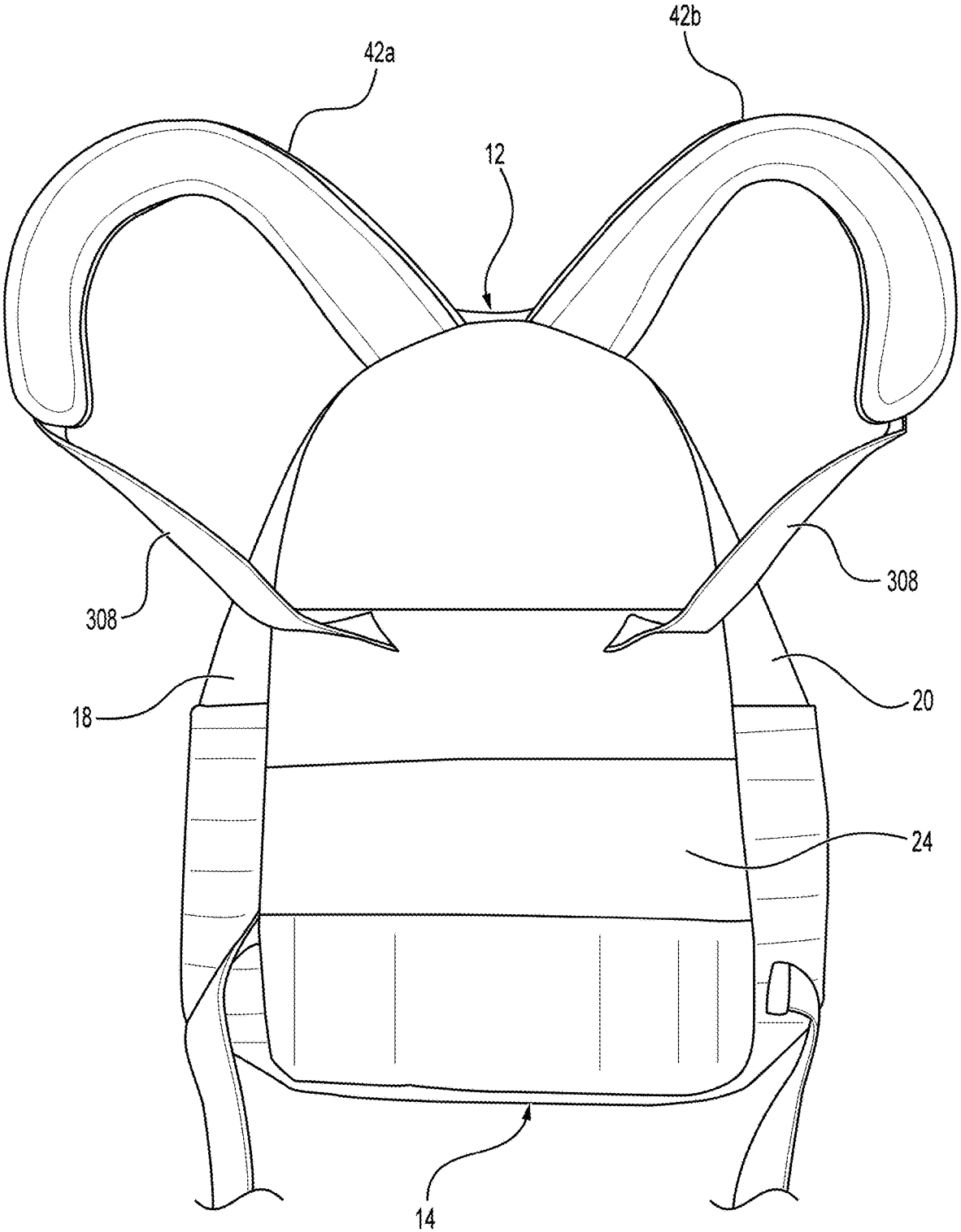
FIG. 4 is a rear view of a rear panel of the storage bag of FIG. 1.

Referring to FIGS. 3 and 4, the main storage compartment 28 is shown with the first panel 16 shown in the open configuration. The main storage compartment 28 includes a roof 28*a* and a bed (not shown) disposed opposite the roof 28*a*. The roof 28*a* is an interior portion of the top end 12. The bed (not shown) is an interior portion of the base 22. The main storage compartment 28 includes one or more slits. In an example, the one or more slits include a first slit 202*a* and a second slit 202*b*. The first slit 202*a* extends through the second panel 24 such that interior portions of the main storage compartment 28 are in communication with the second panel 24. The second slit 202*b* extends through the second panel 24 such that interior portions of the main storage compartment 28 are in communication with the second panel 24.

The main storage compartment 28 includes an adjustment system 300. The adjustment system 300 includes a first strap 302, a base 304, a coupler 306, and a second strap 308. The first strap 302 extends from a first end 302*a* and a second end 302*b*. The first end 302*a* is attached at or near the roof 28*a*. The second end 302*b* is coupled to the coupler 306. In an example, the second strap 308 extends from the first band 42*a* (shown in FIG. 4), through the first slit 202*a*, across the base 304, through the second slit 202*b*, to the second band 42*b* (shown in FIG. 4). In other words, the second strap 308 extends continuously from the first band 42*a* to the second band 42*b*, through interior portions of the main storage compartment 28. The second strap 308 includes a tab 310. The tab 310 extends from the second strap 308 toward the coupler 306. In an example, the tab 310 is coupled with the coupler 306.

In an example, the second strap 308 extends through a central portion of the second panel 24. In another example, the second strap 308 extends through a portion of the second panel 24 disposed nearer the top end 12. In another example, the second strap 308 extends through a portion of the second panel 24 disposed nearer the bottom end 14. In other examples, the second strap 308 may extend through any portion of the second panel 24 as desired to provide a desired amount of posture correction.

The arrangement of the adjustment system 300 provides for posture correction of a user of the storage bag 100. In an example, the adjustment system 300 is configured to transition the storage bag 100 between an engaged configuration and a relaxed configuration. The second strap 308 extends from rings 130*a*, 130*b* of the bands 42*a*, 42*b* to form the respective substraps 132*a*, 132*b* forming a lead that can be pulled by the user of the storage bag 100. The substrap 132*a* can be pulled to adjust a fit of the storage bag 100 to transition the storage bag 100 to the engaged configuration from the relaxed configuration. The substrap 132*b* can be pulled to adjust a fit of the storage bag 100 to transition the storage bag 100 to the engaged configuration from the relaxed configuration. When either or both of the substraps 132*a*, 132*b* are pulled, the tab 310 acts on the coupler 306. For example, the tab 310 pulls the coupler 306 vertically downward toward the bed (not shown) of the main storage compartment 28. In doing so, the coupler 306 pulls the first strap 302 toward the bed (not shown) of the main storage compartment 28. Thus, the bands 42*a*, 42*b* pull the shoulders of the user into a splayed position and the first strap 302 pulls the top portion of the storage bag 100 to push the chest of the user forward.

The base 304 may be made of both a flexible material (e.g., nylon, polyester, or the like) to facilitate flexible movement as well as a semi-rigid material (e.g., paperboard, high density polyethylene, or the like) to provide support, but aspects disclosed herein are not limited to a material of the base 304. For example, the base 304 may alternatively be made entirely of a rigid material (e.g., a hard plastic). In some examples, the base 304 may be entirely made of a flexible material.

Figure 5:
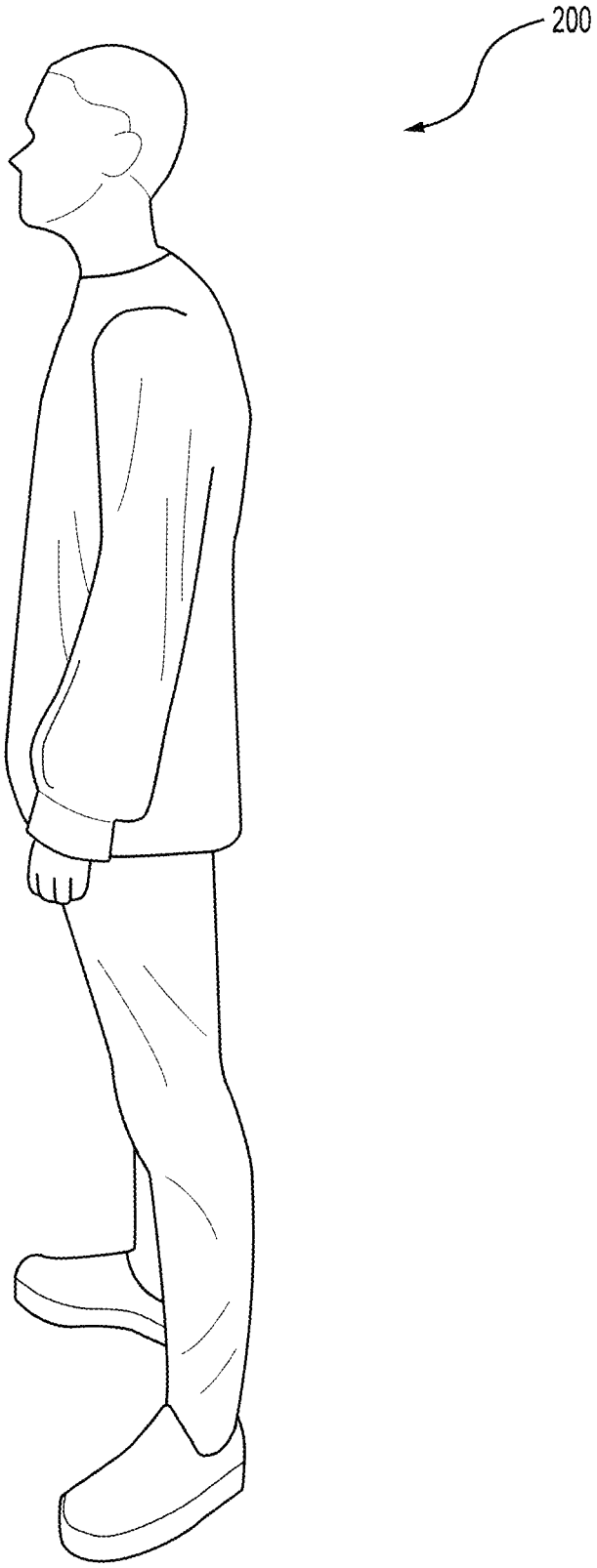
FIG. 5 is a side view of a user without the storage bag of FIG. 1.
Figure 6:
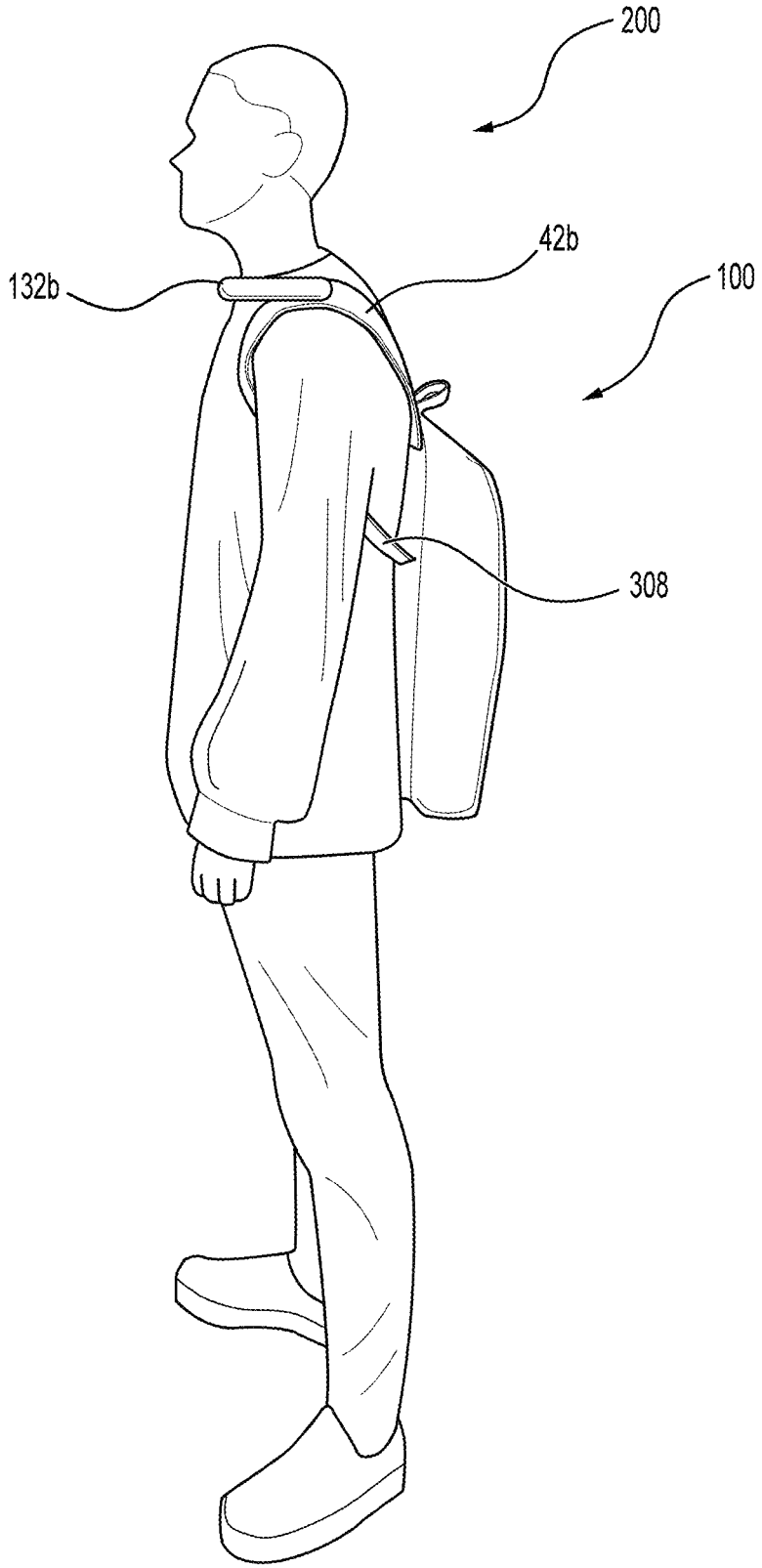
FIG. 6 is a side view of a user with the storage bag of FIG. 1 in a loosened configuration.
Figure 7:
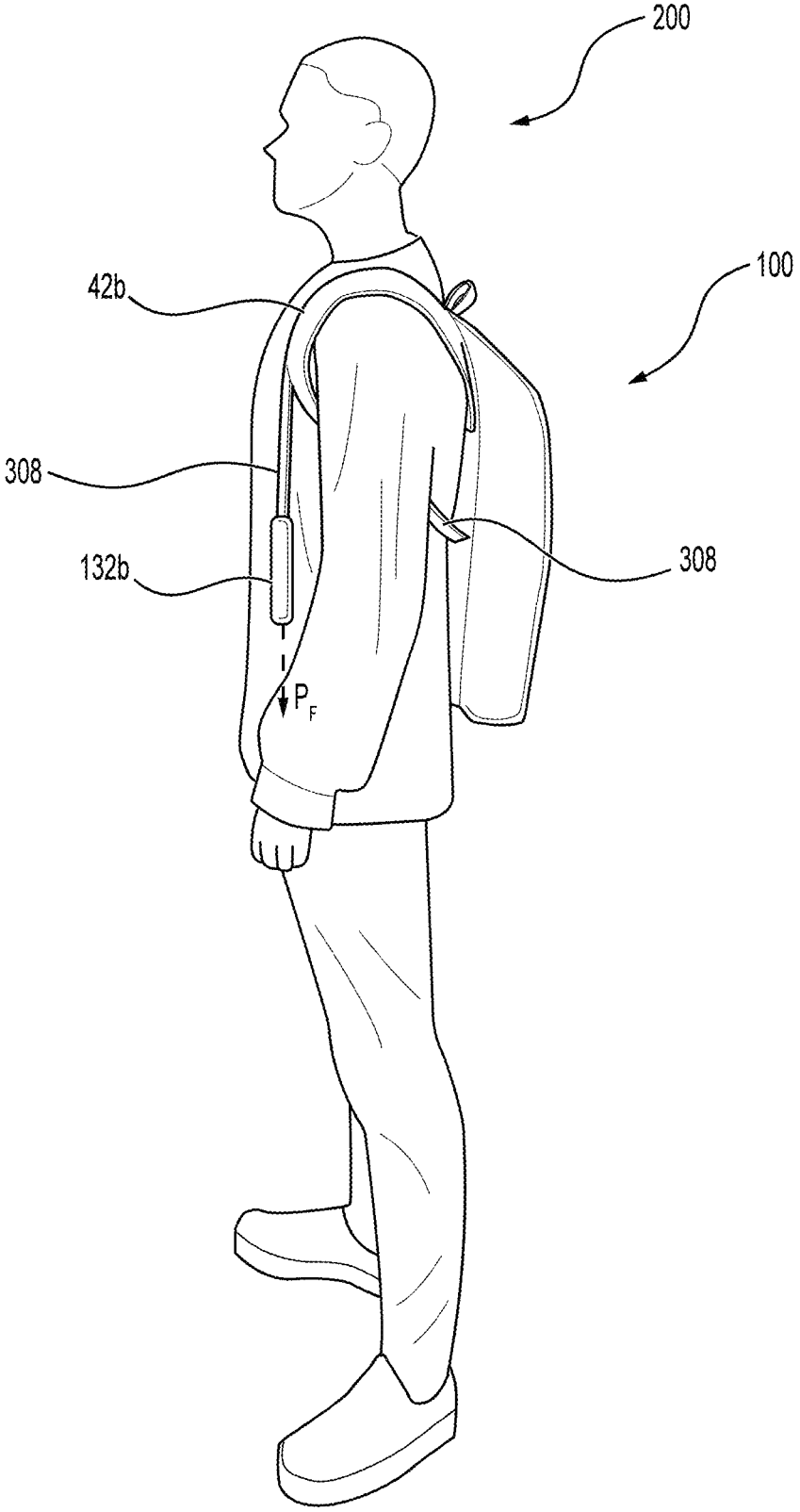
FIG. 7 is a side view of a user with the storage bag of FIG. 1 in a tightened configuration.

FIGS. 5-7 shows a user of the storage bag 100 both with the storage bag 100 and without the storage bag 100. For example, FIG. 5 shows a posture of a user of without the storage bag 100. The user shown in FIG. 5 has a posture that may not be desired and thus correction is desired to ensure proper posture.

FIG. 6 shows the storage bag 100 in the relaxed configuration. In the relaxed configuration, the user's posture is unaltered. The bands 42*a*, 42*b* rest loose around the shoulders of the user and the substrap 132*b* is not pulled taught. For example, the substrap 132*b* has not been pulled away or in a downward motion. The storage bag 100 and the substrap 132*b* only rests as initially placed on the user 200.

FIG. 7 shows the storage bag 100 in the engaged configuration. In the engaged configuration, the user's posture is altered as the bands 42*a*, 42*b* pull back on the shoulders of the user, and the base 304 pushes against the back of the user. For example, the user 200 applies a pulling force $P_F$ to the substrap 132*b* in a downward motion. When the pulling force $P_F$ is applied to the substrap 132*b*, the substrap 132*b* tightens the second strap 308. As the base 304 is pushing against the back of the user and the bands 42*a*, 42*b* pull on the shoulders of the user, the first strap 302 pulls the top of the storage bag 100 and thus the user's upper shoulder and collar bone downward to push the chest of the user forward.

The distance between the substrap 132*b* and the second ring (not shown) may reflect an effective stretchable length of the second strap 308. As has been described, the distance may be adjusted to maintain one or more positions or position ranges of the user's posture during use. The distance may be configured to be in a range of 2 inches to 12 inches, depending on how much the substrap 132*b* is pulled, but aspects disclosed herein are not limited. The distance may further be configured to be in a range of 3 inches to 6 inches. The distance may further be configured to be in a range of 4 inches to 5 inches.

The following clauses provide an exemplary configuration for a storage bag described above.

Clause 1. A bag, comprising: a compartment including one or more walls, a front panel, and a back panel opposite the front panel, each of the one or more walls, front panel, and back panel surrounding an interior volume, wherein the front panel is movable between an open configuration that enables access to the interior volume, and a closed configuration that inhibits access to the interior volume, the front panel extending from a bottom end of the compartment to a top end of the compartment opposite the bottom end, and extending between a first side of the compartment and a second side of the compartment opposite the first side; and an adjustment system including: a base disposed centrally within the compartment; a first strap extending from a first end attached at or near a roof of the compartment to a second end opposite the first end; and a second strap routed through the back panel, wherein the second strap is configured to act on the first strap.

Clause 2. The bag of Clause 1, wherein the base is comprised of both a flexible material and a semi-rigid material.

Clause 3. The bag of Clause 1, wherein the back panel includes a first slit and a second slit, wherein the second strap extends through each of the first slit and the second slit from the compartment to the back panel.

Clause 4. The bag of Clause 3, wherein the bag further comprises: a first band attached to and extending from the back panel; a first ring coupled to the first band; a second band attached to and extending from the back panel; and a second ring coupled to the second band.

Clause 5. The bag of Clause 4, wherein the second strap extends through the first ring on the first band forming a first substrap, and the second strap extends through the second ring on the second band forming a second substrap, the second strap extending continuously from the first band, through the first slit and the second slit, to the second band.

Clause 6. The bag of Clause 1, wherein the second strap further includes a tab, the tab extending away from the second strap towards the roof of the compartment.

Clause 7. The bag of Clause 6, wherein the adjustment system further includes a coupler, the coupler coupled with the second end of the first strap and the tab of the second strap.

Clause 8. The bag of Clause 7, wherein the second strap is configured to be pulled by a user of the bag, and wherein when pulled, the tab of the second strap is configured to pull on the first strap via the coupler, thereby to push the base against a back of the user of the bag.

Clause 9. The bag of Clause 1, wherein the second strap is in communication with the interior volume and external portions of the bag.

Clause 10. The bag of Clause 1, wherein the bag is configured to transition between an engaged configuration and a relaxed configuration, wherein in the engaged configuration the second strap is configured to pull the shoulders of a user of the bag into a splayed position, and in the relaxed configuration the second strap is configured to allow the shoulders of the user to relax.

Clause 11. A bag, comprising: a compartment including one or more walls, a roof, a front panel, and a back panel opposite the front panel each surrounding an interior volume; a first band attached to the back panel; a second band attached to the back panel; and an adjustment system including: a base disposed within the interior volume of the compartment; a first strap extending from a first end attached at or near the roof of the compartment to a second end opposite the first end; a second strap routed through the back panel and the interior volume of the compartment, the second strap communicably coupling the first band and the second band, wherein the second strap includes a tab extending away from the second strap to the roof of the compartment; and a coupler coupled with the second end of the first strap and the tab of the second strap, wherein the second strap is configured to pull the first strap vertically downward away from the roof via the coupler.

Clause 12. The bag of Clause 11, wherein the first band includes a first ring and the second band includes a second ring, the second strap extending through the first ring to form a first substrap and the second strap extending through the second ring to form a second substrap.

Clause 13. The bag of Clause 12, wherein when either of the first substrap or the second substrap are pulled by a user of the bag, the first band and the second band are configured to pull back on shoulders of the user into a splayed position.

Clause 14. The bag of Clause 13, wherein the base is configured to push against a back of the user to support the back of the user.

Clause 15. The bag of Clause 12, wherein each of the first substrap and the second substrap are configured to reach a length of between 2 inches and 12 inches.

Clause 16. The bag of Clause 11, wherein the base is comprised of a flexible material as well as a semi-rigid material.

Clause 17. A bag, comprising: a compartment including one or more walls, a roof, a front panel, and a back panel opposite the front panel, each of the one or more walls, the roof, the front panel, and the back panel surrounding an interior volume; a first band attached to the back panel; a second band attached to the back panel; and an adjustment system including: a base comprised of flexible material as well as a semi-rigid material; a first strap extending from a first end attached at or near the roof of the compartment to a second end opposite the first end; and a second strap routed from the first band to the second band through the interior volume of the compartment, the second strap configured to transition the bag between an engaged position and a relaxed position, wherein the second strap is configured to act on the first strap in the engaged position.

Clause 18. The bag of Clause 17, wherein the second strap includes a tab extending away from the second strap toward the roof of the compartment.

Clause 19. The bag of Clause 18, wherein the adjustment system further includes a coupler, the coupler coupled to the second end of the first strap and the tab of the second strap.

Clause 20. The bag of Clause 19, wherein in the engaged position the second strap is pulled taught to pull the first strap via the coupler and the first strap pulls the roof of the compartment to pull the first band and the second band into an engaged position splaying shoulders of a user of the bag.

Clause 21. The bag of Clause 17, wherein in the relaxed position, the second strap rests loose.

I claim:

1. A bag, comprising:

a compartment including one or more walls, a front panel, and a back panel opposite the front panel, each of the one or more walls, front panel, and back panel surrounding an interior volume, wherein the front panel is movable between an open configuration that enables access to the interior volume, and a closed configuration that inhibits access to the interior volume, the front panel extending from a bottom end of the compartment to a top end of the compartment opposite the bottom end, and extending between a first side of the compartment and a second side of the compartment opposite the first side, the back panel including a first slit and a second slit; and an adjustment system including:

a base disposed centrally within the compartment;

a first strap extending from a first end attached at or near a roof of the compartment to a second end opposite the first end; and a second strap routed through the back panel, the second strap extending through each of the first slit and the second slit from the compartment to the back panel, wherein the second strap is configured to act on the first strap.

2. The bag of claim 1, wherein the base is comprised of both a flexible material and a semi-rigid material.

3. The bag of claim 1, wherein the bag further comprises:

a first band attached to and extending from the back panel;

a first ring coupled to the first band;

a second band attached to and extending from the back panel; and a second ring coupled to the second band.

4. The bag of claim 3, wherein the second strap extends through the first ring on the first band forming a first substrap, and the second strap extends through the second ring on the second band forming a second substrap, the second strap extending continuously from the first band, through the first slit and the second slit, to the second band.

5. The bag of claim 1, wherein the second strap further includes a tab, the tab extending away from the second strap towards the roof of the compartment.

6. The bag of claim 5, wherein the adjustment system further includes a coupler, the coupler coupled with the second end of the first strap and the tab of the second strap.

7. The bag of claim 6, wherein the second strap is configured to be pulled by a user of the bag, and wherein when pulled, the tab of the second strap is configured to pull on the first strap via the coupler, thereby to push the base against a back of the user of the bag.

8. The bag of claim 1, wherein the second strap is in communication with the interior volume and external portions of the bag.

9. The bag of claim 1, wherein the bag is configured to transition between an engaged configuration and a relaxed configuration, wherein in the engaged configuration the second strap is configured to pull the shoulders of a user of the bag into a splayed position, and in the relaxed configuration the second strap is configured to allow the shoulders of the user to relax.

10. A bag, comprising:

a compartment including one or more walls, a roof, a front panel, and a back panel opposite the front panel each surrounding an interior volume;

a first band attached to the back panel;

a second band attached to the back panel; and an adjustment system including:

a base disposed within the interior volume of the compartment;

a first strap extending from a first end attached at or near the roof of the compartment to a second end opposite the first end;

a second strap routed through the back panel and the interior volume of the compartment, the second strap communicably coupling the first band and the second band, wherein the second strap includes a tab extending away from the second strap to the roof of the compartment; and a coupler coupled with the second end of the first strap and the tab of the second strap, wherein the second strap is configured to pull the first strap vertically downward away from the roof via the coupler.

11. The bag of claim 10, wherein the first band includes a first ring and the second band includes a second ring, the second strap extending through the first ring to form a first substrap and the second strap extending through the second ring to form a second substrap.

12. The bag of claim 11, wherein when either of the first substrap or the second substrap are pulled by a user of the bag, the first band and the second band are configured to pull back on shoulders of the user into a splayed position.

13. The bag of claim 12, wherein the base is configured to push against a back of the user to support the back of the user.

14. The bag of claim 11, wherein each of the first substrap and the second substrap are configured to reach a length of between 2 inches and 12 inches.

15. The bag of claim 10, wherein the base is comprised of a flexible material as well as a semi-rigid material.

16. A bag, comprising:

a compartment including one or more walls, a roof, a front panel, and a back panel opposite the front panel, each of the one or more walls, the roof, the front panel, and the back panel surrounding an interior volume;

a first band attached to the back panel;

a second band attached to the back panel; and an adjustment system including:

a base comprised of flexible material as well as a semi-rigid material;

a first strap extending from a first end attached at or near the roof of the compartment to a second end opposite the first end; and a second strap routed from the first band to the second band through the interior volume of the compartment, the second strap configured to transition the bag between an engaged position and a relaxed position, wherein the second strap is configured to act on the first strap in the engaged position.

17. The bag of claim 16, wherein the second strap includes a tab extending away from the second strap toward the roof of the compartment.

18. The bag of claim 17, wherein the adjustment system further includes a coupler, the coupler coupled to the second end of the first strap and the tab of the second strap.

19. The bag of claim 18, wherein in the engaged position the second strap is pulled taught to pull the first strap via the coupler and the first strap pulls the roof of the compartment to pull the first band and the second band into an engaged position splaying shoulders of a user of the bag.

* * * * *